US006139009A

United States Patent [19]

Eckert

[11] Patent Number: 6,139,009

[45] Date of Patent: Oct. 31, 2000

[54] DEVICE AND PROCESS FOR DELIVERING IMBRICATED PRODUCTS

[75] Inventor: Günther Oskar Eckert, Zellingen, Germany

[73] Assignee: Koenig & Bauer-Albert Aktiengesellschaft, Wurzburg, Germany

[21] Appl. No.: 09/101,295

[22] PCT Filed: Dec. 20, 1996

[86] PCT No.: PCT/DE96/02498

§ 371 Date: Jul. 8, 1998

§ 102(e) Date: Jul. 8, 1998

[87] PCT Pub. No.: WO97/25269

PCT Pub. Date: Jul. 17, 1997

[30] Foreign Application Priority Data

Jan. 8, 1996 [DE] Germany ..... 196 00 374

[51] Int. Cl.[7] ..... B65H 29/00

[52] U.S. Cl. ..... 271/187; 271/216; 271/311; 271/312; 271/313; 271/315; 270/60; 148/478.1; 148/482.1

[58] Field of Search ..... 198/478.1 C, 479.1, 198/482.1 C, 644; 271/187, 216, 311, 312, 313, 315; 270/60

[56] References Cited

U.S. PATENT DOCUMENTS

| | | | |
|---|---|---|---|
| 2,014,933 | 9/1935 | Harless et al. | 271/80 X |
| 4,834,361 | 5/1989 | Fenske et al. . | |
| 4,865,307 | 9/1989 | Crofutt et al. . | |
| 4,971,303 | 11/1990 | Lange et al. | 270/60 |
| 5,028,045 | 7/1991 | Muller | 271/271 X |
| 5,611,530 | 3/1997 | Maresse et al. . | |

FOREIGN PATENT DOCUMENTS

| | | |
|---|---|---|
| 0179992 | 5/1986 | European Pat. Off. . |
| 0302169 | 2/1989 | European Pat. Off. . |
| 0677471 | 10/1995 | European Pat. Off. . |
| 642249 | 3/1937 | Germany . |
| 3827701 | 3/1989 | Germany . |

*Primary Examiner*—Joseph E. Valenza
*Assistant Examiner*—Kenneth W Bower
*Attorney, Agent, or Firm*—Jones, Tullar & Cooper PC

[57] ABSTRACT

A device and a method for depositing products or signatures on a conveying belt utilizes both a fixed stripper and a rotating stripper, in conjunction with a delivery paddle wheel. The cooperation of the fixed and rotating strippers deposits the signatures or folded products onto the delivery belt in an efficient manner while preventing damage to the products or signatures.

12 Claims, 4 Drawing Sheets

DEVICE AND PROCESS FOR DELIVERING IMBRICATED PRODUCTS

FIELD OF THE INVENTION

The present invention relates to a device and a process for depositing signatures or folded products. A paddle wheel is provided with a stationary stripper that acts on a leading edge of a product. At least one movable second stripper projects into the paddle wheel. At least one conveyor belt is located downstream of the second movable stripper.

DESCRIPTION OF THE PRIOR ART

DE 38 27 701 A1 describes a device for the overlapped deposition of printed products for a web-fed rotary printing press. This device essentially consists of a paddle wheel, into which a stationary stripper extends, air nozzles for affecting the braking process, air nozzles for affecting the acceleration process during deposit, a number of transport rollers and a conveyor belt. The stationary stripper slows a product located in a pocket of the paddle wheel, so that it is conveyed out of the paddle wheel. After the product has been partially pushed out of the pocket, a rear end of the product is grasped by the transport rollers and accelerated to the speed of the conveyor belt.

In connection with this prior art device, it is disadvantageous that the transport rollers initially grasp the open end of the product and thereby "push" the product. Because of this the product can become bent and damaged.

It is furthermore disadvantageous that the air pressure required for the precise slowing and acceleration of the products is not only determined by the speed, but also by the mass inertia and surface condition of the printed products and must be respectively matched to these.

A device and a method for transporting and depositing signatures has become known from EP-A-0 302 169. A paddle wheel and a transport belt are provided for this purpose. A revolving stripper is provided in the range of action of the paddles, which assists the overlapping deposit of the signatures on the transport belt. The paddle wheel and the stripper rotate in the same direction.

A device and a method for collecting sheet-shaped signatures has become known from EP-A-0 179 992. A paddle wheel with paddles for transporting the signatures is provided. At a suitable location they are dropped in stacks onto a transport belt by a guided moving belt. A pivotable buffer, which projects into the range of action of the paddles and is synchronized with them, is provided. This buffer can also be designed to be not pivotable.

SUMMARY OF THE INVENTION

The present invention is directed to the object of creating a device for depositing signatures, or respectively folded products, on a movable distributor.

This object is attained in accordance with the present invention by a device and a method which utilizes a paddle wheel for depositing signatures or folded products onto a downstream conveyor belt. The paddle wheel has a movable stripper with a circumferential stripper surface that acts on a leading edge of a product. At least one stationary stripper projects into the paddle wheel. The movable stripper is rotatably driven and intersects a periphery of the stationary stripper.

The removal of products from a paddle wheel in accordance with the present invention is achieved in an advantageous manner in two steps: first, the product is slowed to almost a standstill in the circumferential direction by means of a stationary stripper and in this way is partially pushed out of the pocket of the paddle wheel. Subsequently a revolving stripper, which acts on the front end of the product, accelerates the products to almost the transport speed of the conveyor belts. The following advantages ensue by means of this two-step removal of the product from the pocket: stationary strippers impart almost no pressure forces in the radial direction of the paddle wheel, by means of which a rapid, low-friction removal of the product without noticeable deformation takes place. By the appropriate placement of the stationary stripper, it is possible to generate a large differential speed between the inside of the paddle wheel and the product resting thereon. Because of this, the removal process can take place within a relatively short interval. In addition, longer fan paddles can be employed because of this, which hold the printed product better during the fan rotation.

Because of their shape and placement, revolving strippers make possible the gentle, frictionally connected acceleration of the product to almost the transport speed of the conveyor belts.

A variable spacing, for example an overlapping spacing, of the deposited products becomes possible by changing the ratio of the circumferential speeds of the paddle wheel and the revolving stripper, for example by means of a drive which is independent of the paddle wheel.

By the utilization of a wheel-shaped stripper, that is moving along with the deposited products it is possible in an advantageous manner to clamp the deposited products between the belt-shaped stripper and a following conveyor belt. The products are fixed in place on the conveyor belt in this way and their sliding out of place is prevented, which assures a good quality of the overlapped flow.

The area in which the printed products are clamped between the stripper and the conveyor belt can be extended by means of a belt-shaped stripper moving along with them.

BRIEF DESCRIPTION OF THE DRAWINGS

The device in accordance with the present invention is represented in the drawings and will be described in more detail in what follows.

Shown are in

DESCRIPTION OF THE PREFERRED EMBODIMENTS

A device for depositing, for example in an overlapping manner, signatures; i.e. a number of not yet folded sheets or products 1; i.e. folded signatures, in particular of folded, sheet-like paper products, is connected downstream of a rotary printing press, for example. This device essentially consists of a paddle wheel 2, stationary strippers 3, and revolving strippers 4.

Figure 2:
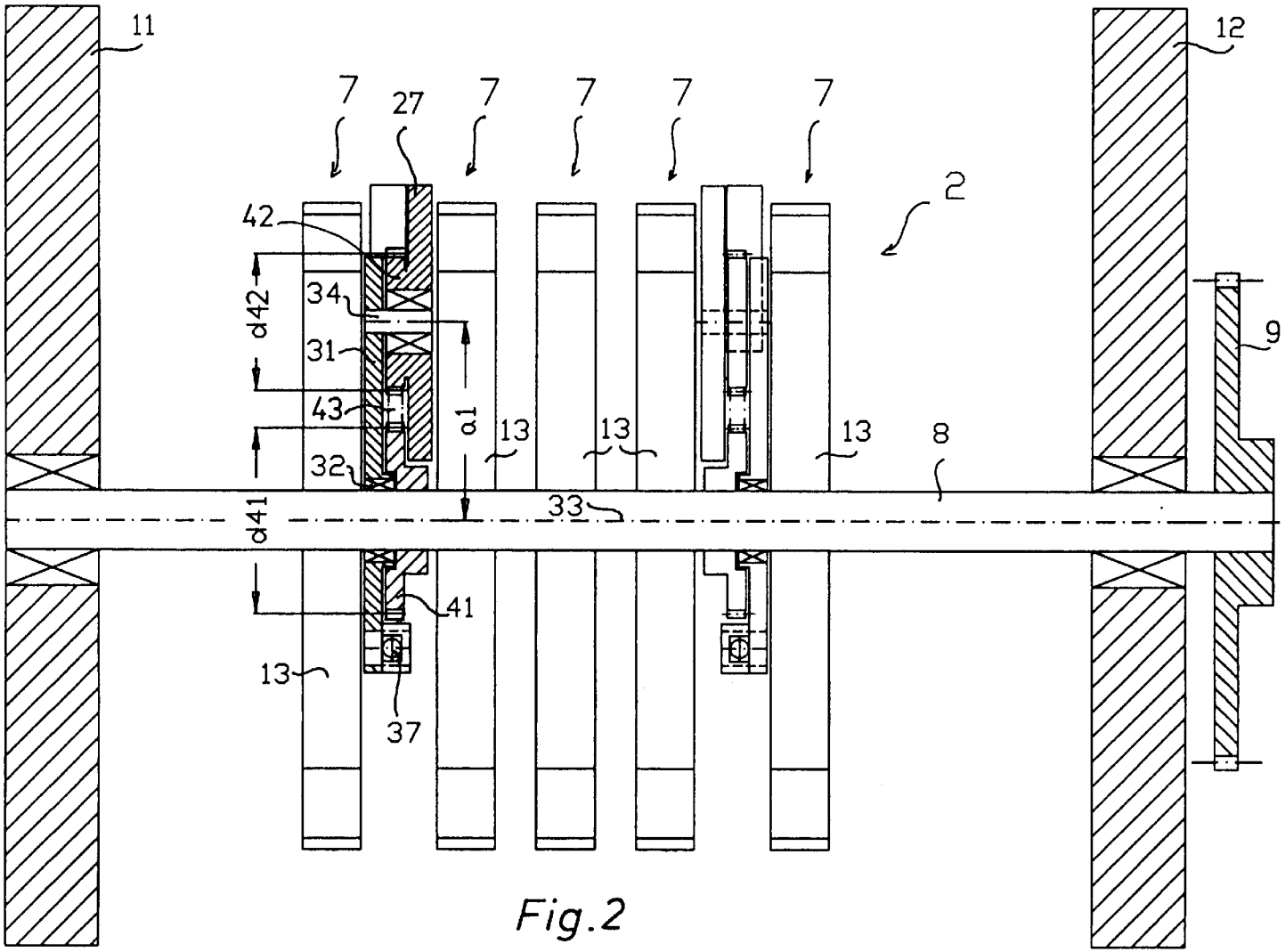
FIG. 2, a schematic top view of a first preferred embodiment of the device in accordance with the present invention.

The paddle wheel 2 is constituted of a plurality of individual disks 7, as seen in FIG. 2, which are fastened, respectively spaced apart from each other, in a torsion-proof manner on a common shaft 8. This shaft 8 is connected in a torsion-proof manner with a drive wheel 9 and is rotatably seated in lateral frames 11, 12.

Each one of these disks 7 has a hub 13 arranged on the shaft 8, which hub 13 is connected, by means of radially oriented spokes 14, with a ring-shaped paddle support 16. This paddle support 16 is provided with a contour which is sawtooth-like in cross section. Paddles 18, which are oriented radially outward and which extend approximately in the tangential direction in respect to the shaft 8, are fastened on a surface 17 of the paddle support 16. In their longitudinal direction these paddles 18 are slightly curved, and are embodied slightly inclined in respect to the tangential direction of the paddle support 16. These paddles 18 are fastened, spaced apart from each other and overlapping in the circumferential direction, so that a pocket 22 is formed between an outward facing side 19 of a paddle 18 which trails, viewed in the direction of rotation of the paddle wheel 2, and an inward facing side 21 of a leading paddle 18. This pocket 22 has a cross section which tapers towards the pocket bottom 23. Rigid strippers 3, which are fixed in place on the frame, are arranged between the individual disks 7 and project in a rake-like manner into the paddle wheel 2. In the first preferred embodiment these strippers 3 are angled, so that a first leg 24, of the rigid stripper 3 which terminates in the area of the pocket bottom 23, is arranged inclined toward the interior in respect to the tangential direction of the paddle wheel 2. A second leg 26 of the rigid or stationary stripper 3 extends approximately parallel with the downstream connected conveyor belt 6.

Figure 1:
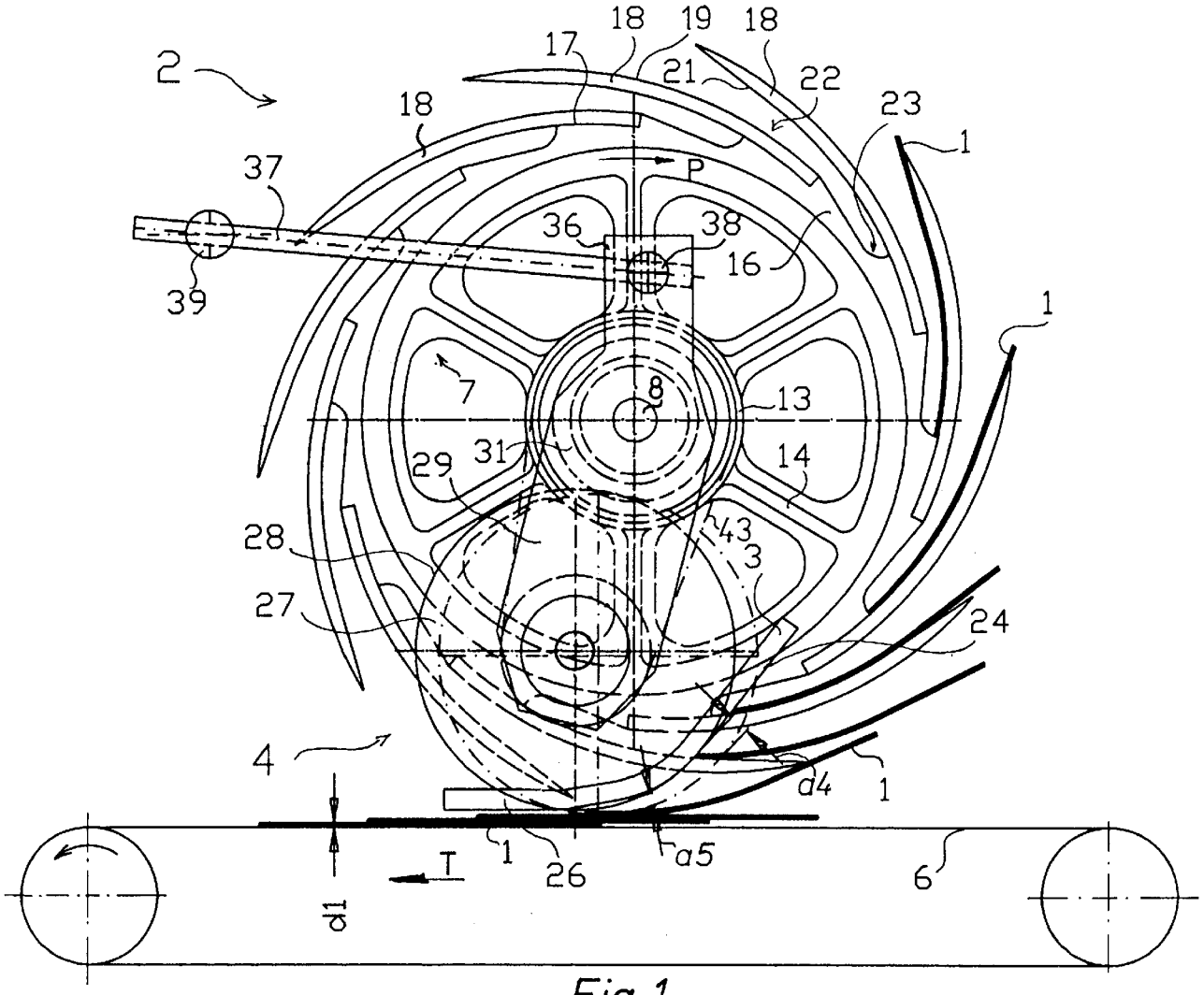
FIG. 1, a schematic lateral view of a first preferred embodiment of the device in accordance with the present invention.

Two revolving strippers 4 are arranged, for example, in spaces between the two outer disks 7, viewed in the axial direction of the paddle wheel 2, and as seen in FIGS. 1 and 2. It is also possible to provide only a single, or also a plurality of revolving strippers 4, each with revolving stripper surfaces 28. These revolving strippers 4 are arranged so they can be adjusted in such a way that they intersect a periphery of the first leg 24 of the rigid stripper 3, or of its virtual extension, so or that they extend by a projection distance a4 past a periphery of the first leg 24 or its virtual extension, and by a projection distance a5 past the second leg 26 or its virtual extension of the rigid stripper 3 counter to the production direction P of the paddle wheel 2.

In the present first preferred embodiment, the revolving stripper 4 is designed as a driven wheel 27. On its stripping surface 28, i.e. the surface 28, this wheel 27 has a large coefficient of friction, to which end this surface 28 is coated, for example, with a plastic material such as polyurethane. Two of these driven wheels 27 are arranged in spaces between the respectively two outer disks 7 of the paddle wheel 2, as seen most clearly in FIG. 2. Each of these wheels 27 is arranged to be adjustable in such a way that at least the projection distance a4 can be changed. In the present example, each wheel 27 is rotatably seated on a first arm 29 of a two-armed pivot lever 31 for this purpose. This pivot lever 31 is pivotably seated on the shaft 8 of the paddle wheel 2 by means of a bearing 32, so that an axial distance al between the axes of rotation 33, 34 of the shaft 8 and the wheel 27 of, for example, a1=175 mm results. An adjustment device for pivoting the pivot lever 31, and therefore for setting the projection a4, acts on a second arm 36 of the pivot lever 31. In the first preferred embodiment, this adjustment device is embodied as a threaded spindle 37, whose first end rotatingly engages a threaded nut 38 seated in the second arm 36 of the pivot lever 31, and whose second end is seated rotatably, but fixed in place in the longitudinal direction of the threaded spindle 37, in the lateral frames 11, 12 by means of a nut 39. Driving devices, for example stepping motors, can of course be arranged on these threaded spindles 37 in order to make possible the remote adjustment of the wheels 27.

Figure 4:
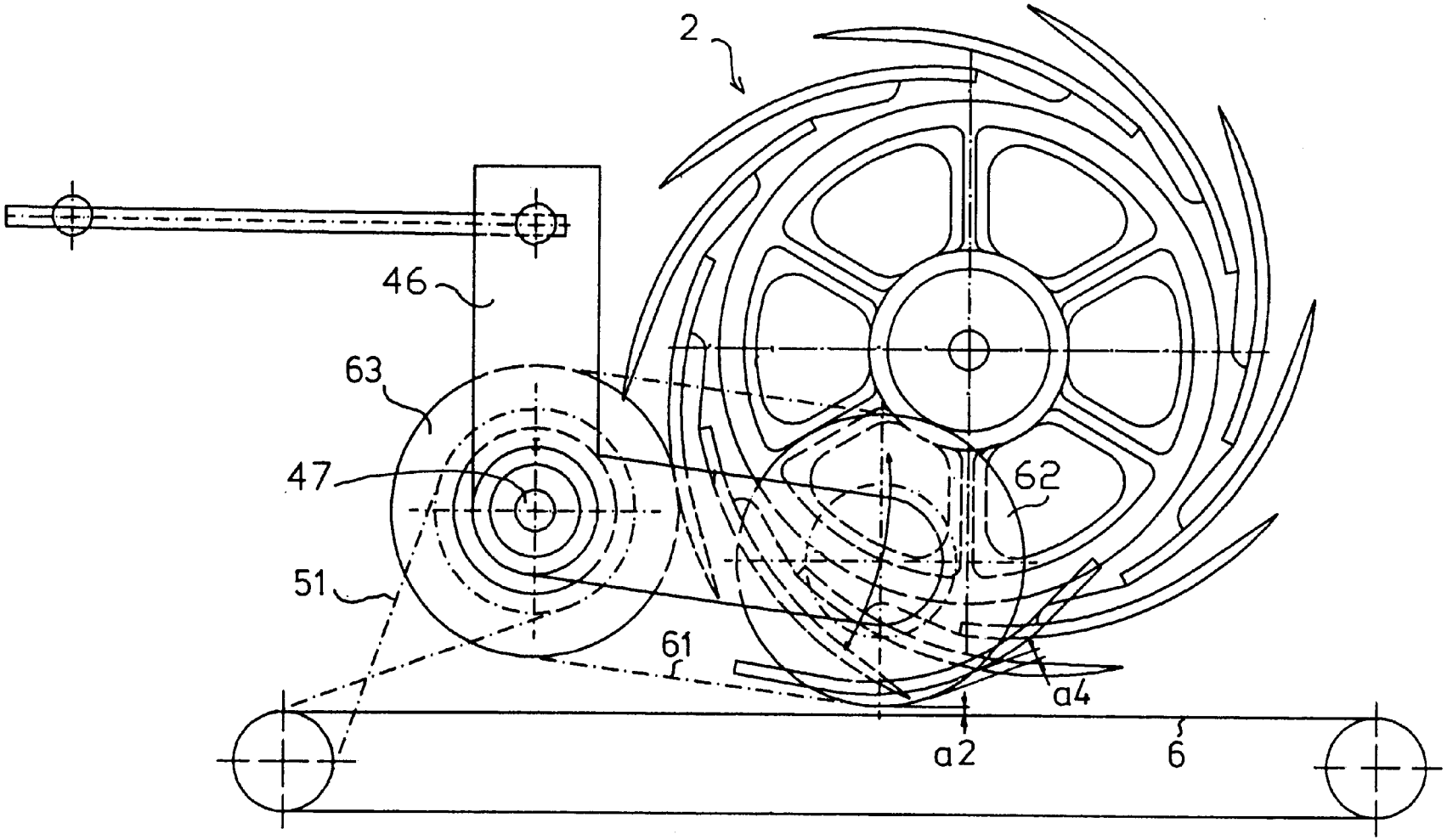
FIG. 4, a schematic lateral view of a third preferred embodiment of the device in accordance with the present invention.

The driven stripper wheel 27 has a distance a2, as seen in FIG. 4, from the conveyor belt 6, for example, a2=9 mm, which preferably is less than a thickness d1, for example d1=10 mm, of a product 1 to be deposited.

The circumferential speed u27 of the driven stripper wheel 27 is less than the circumferential speed u2 of the paddle wheel 2. Preferably, the ratio of the circumferential speed u27 of the stripper wheel 27 to the circumferential speed u2 of the paddle wheel 2 is 0.6 to 0.95, i.e. u27:u2=0.6 to 0.95. The stripper wheel 27, the same as the paddle wheel 2, turns in the production direction P. To this end, a forced drive, emanating from the shaft 8 of the paddle wheel 2, is provided as a drive for the driven stripper wheel 27 in the represented first preferred embodiment depicted in FIG. 1 and FIG. 2. For example, the shaft 8 is connected in a torsion-proof manner with a first pulley 41 with an effective diameter d41, and the driven stripper wheel 27 is provided with a second pulley 42 with an effective diameter d42. The second pulley 42 is driven by the first pulley 41 by means of a belt 43, for example a toothed belt 43. In place of a belt drive it is also possible to provide a chain drive or a gear wheel drive.

Figure 3:
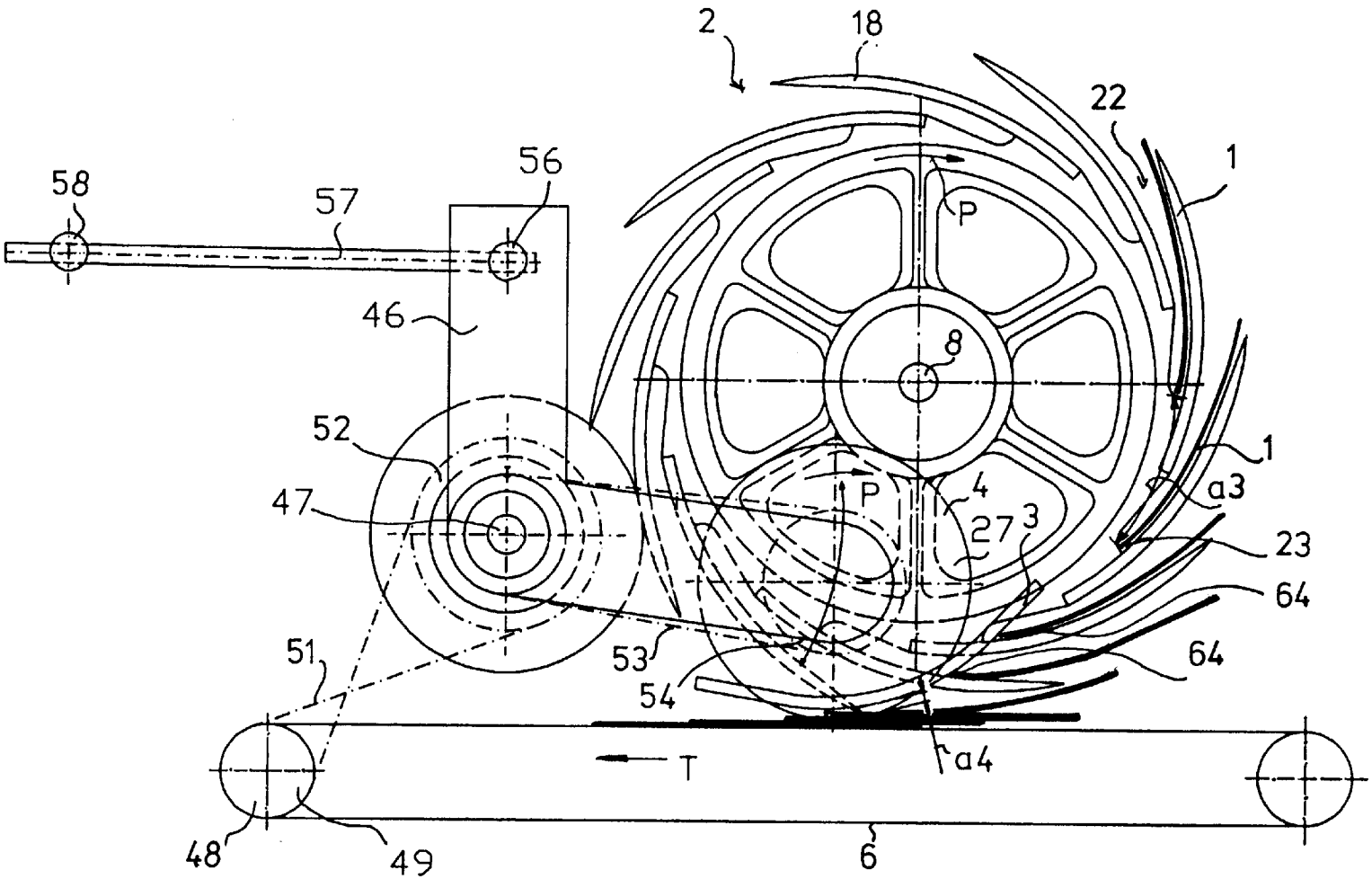
FIG. 3, a schematic lateral view of a second preferred embodiment of the device in accordance with the present invention.

In a second preferred embodiment as seen in FIG. 3, respectively one bearing arm 46 for seating the two driven stripper wheels 27 is pivotably seated, independently of the shaft 8 of the paddle wheel 2, on its own shaft 47, which shaft 47 is fastened in the lateral frames 11, 12. Here again two driven stripper wheels 27 are arranged in the axial direction of the paddle wheel 2. In what follows, only the arrangement of one wheel 27 on one side will be described, the second side is similarly embodied:

The drive of this driven stripper wheel 21 is provided from the conveyor belt 6. A belt roller 48 of the conveyor belt 6 has a drive whose rpm can be controlled, for example a rotary current motor, which is synchronized with the paddle wheel 2, and a pulley 49. From this pulley 49 a crossed belt 51, for example, leads to a pulley 52, which is freely rotatable on the shaft 47 and from which a toothed belt 53 leads to a pulley 54, which is fixedly connected with the driven stripper wheel 27. Thus the circumferential speed u4 of the revolving stripper 4 can be changed independently of the circumferential speed u2 of the paddle wheel 2.

A threaded spindle 57, having a first end which is seated in a threaded nut 56 and whose other end is rotatably fastened in a nut 58, that is fixed in place in its longitudinal direction in the lateral frames 11, 12, acts on the bearing arm 46. By turning this threaded spindle 57, the bearing arm 46 can be pivoted around its shaft 47, and a projection a4 between the stationary stripper 3 and the driven stripper wheel 27 can be changed thereby.

In a third preferred embodiment as seen in FIG. 4, the revolving stripper 4 is embodied as a driven stripper belt 61. To this end, a guide wheel 62 is provided on the bearing arm 46, and a rotatable wheel 63, which is aligned with the guide wheel 62, is provided on the shaft 47, in place of the driven stripper wheel 27 in the second preferred embodiment. A stripper belt 61, for example a flat belt, runs over these two wheels 62, 63, for moving the products 1. The two wheels 62, 63 are arranged in such a way that the stripper belt 61 extends approximately parallel with the conveyor belt 6.

In this way, the products 1 can be clamped for guidance between the stripper belt 61 and the conveyor belt 6. In this preferred embodiment, too, the projection a4 between the stationary stripper 3 and the stripper belt 61 as well as the distance a2 between the conveyor belt 6 and the stripper belt 61 can be changed.

In place of the drive for the revolving stripper 4, which depends on the paddle wheel 2 or the conveyor belt 6, it is of course also possible to provide this revolving stripper 4 with its own, completely independent drive, whose rpm can be controlled. In this way the circumferential speeds u2, u4, u6 of the paddle wheel 2, the revolving stripper 4 and the conveyor belt 4 can be controlled independently of each other.

The functioning of the device in accordance with the present invention will be described, by way of example by means of the second preferred embodiment as seen in FIG. 3:

The products 1 are conveyed by devices, not specifically represented, into the pockets 22 of the paddle wheel 2. The paddle wheel 2 with the pockets 22 filled with products 1 turns in the production direction P until the leading edge 64 of the products 1, which are situated in the pocket bottoms 23, comes into contact with the stationary strippers 3 in the pocket. By means of this, the products 1, which are initially being moved at the circumferential speed u2 of the paddle wheel 2, are greatly slowed in the circumferential direction. Now the products 1 only have a slow speed in respect to the circumferential direction of the paddle wheel 2, while the paddle wheel 2 continues to turn and therefore the products 1 slide out of the pocket 22. Because of this the distance a3 between the leading edges 64 two successive products 1 is reduced. This distance as is determined by the distance a3 in the circumferential direction of two pockets 22 on the paddle support 16. The product 1 is therefore conveyed out of the pocket 22, wherein essentially only forces in the tangential direction of the paddle wheel 2, i.e. in the longitudinal direction of the pocket 22, occur, and not in the radial direction. In the process, the product 1 makes a movement in the radial direction based on the shape of the paddles 18, so that its leading edge 64 now comes into contact with the revolving stripper 4. The revolving stripper 4 grasps the product 1, which is at rest in relation to the conveying direction T of the conveyor belt 6, and accelerates it in the conveying direction T to almost the conveying speed of the conveyor belt 6. When the product 1 has almost vacated the pocket 22, it is pressed on the conveyor belt 6 by the revolving stripper 4. The conveyor belt 6 conveys the products 1, which have been overlappingly deposited, to downstream located processing installations, not represented.

The overlap distance of the products 1 on the conveyor belt results from the ratio between the circumferential speeds of almost equal size u4, or respectively u6, of the revolving stripper 4 and the conveyor belt 6, and the circumferential speed u2 and the division, i.e. the distance a3, of the paddle wheel 2.

The revolving stripper 4 can be adjusted in such a way that the stripper 4 presses the products 1 against the conveyor belt 6 with a variable force.

While preferred embodiments of a device and process for depositing signatures or folded products in accordance with the present invention have been set forth fully and completely hereinabove, it will be apparent that a number of changes in, for example the type of printing press being used, the number of sheets in the products or signatures, the type of downstream processing device and the like may be made without departing from the true spirit and scope of the present invention which is accordingly to be limited only by the following claims.

What is claimed is:

1. A device for depositing products comprising:

a paddle wheel, said paddle wheel having a plurality of product receiving pockets;

means for rotating said paddle wheel in a production direction;

at least a first stationary stripper having a periphery, said stationary stripper being, located with said periphery positioned to engage leading edges of products in said product receiving pockets and to strip said products from said product receiving pockets as said paddle wheel is rotated in said production direction;

at least a first revolving stripper having a movable stripper surface, said movable stripper surface intersecting an extension of said periphery of said at least first stationary stripper and extending by a projection distance in a stripping direction with respect to said stationary stripper, said movable stripper surface engaging said products stripped from said product receiving pockets by said at least first stationary stripper;

means for adjusting said projection distance of said movable stripper surface of said revolving stripper during operation of said paddle wheel; and a downstream conveyor belt positioned at a distance from said movable stripper surface to receive products stripped from said paddle wheel by said stationary stripper and said revolving stripper.

2. The device of claim 1, wherein said revolving stripper is a rotating wheel.

3. The device of claim 1, wherein said revolving stripper is a revolving stripper belt.

4. The device of claim 1, wherein said paddle wheel and said revolving stripper have a common rotational direction.

5. The device of claim 1, wherein said paddle wheel has a first circumferential speed and wherein said movable stripper has a second circumferential speed, and further wherein a ratio of said second circumferential speed to said first circumferential speed is between 0.6 and 0.95.

6. The device of claim 1, further including a common drive for said revolving stripper and said downstream conveyor belt, said common drive having a controllable rpm.

7. The device of claim 1, further including an independent drive for said revolving stripper.

8. The device of claim 1, wherein said movable stripper surface of said movable stripper has a product engaging layer with a high coefficient of friction.

9. The device of claim 1, further including means to adjust said distance between said downstream conveyor belt and said stripper movable surface of said revolving stripper.

10. The device of claim 3, wherein said revolving stripper belt is generally parallel with said downstream conveyor belt.

11. A method for depositing products onto a product conveyor belt including:

providing a rotatable paddle wheel having a plurality of product receiving pockets;

providing means for rotating said paddle wheel in a production direction;

depositing products in said product receiving pockets;

positioning a stationary stripper having a periphery for engagement with said products in said products;

rotating said paddle wheel in said production direction to bring a leading edge of said products deposited in said product receiving pockets into engagement with said periphery of said stationary stripper;

using said stationary stripper to slow said products with respect to said rotating paddle wheel and to at least partially push said products out of said pockets;

moving said leading edges of said products radially outwardly with respect to said paddle wheel during continued rotation of said paddle wheel in said production direction;

situated a revolving stripper having a movable stripper surface intersecting an extension of said periphery and extending by a projection distance beyond said periphery after, in a direction of travel of said products in said projection direction, said stationary stripper;

supporting said revolving stripper for adjusting said projection distance of said movable stripper surface during operation of said paddle wheel;

bringing said leading edges of said products into engagement with said movable stripper surface;

providing a product receiving conveyor belt adjacent said movable stripper surface; and using said movable stripper surface to accelerate said products and to deposit said products on said conveyor belt.

12. The method of claim 11, further including clamping said products on said conveyor belt by engaging said movable stripper surface of said revolving stripper with said products.

* * * * *